US007339324B2

(12) United States Patent
Lee et al.

(10) Patent No.: US 7,339,324 B2
(45) Date of Patent: Mar. 4, 2008

(54) ELECTRON EMISSION DEVICE AND ELECTRON EMISSION DISPLAY USING THE SAME

(75) Inventors: Sang Jin Lee, Suwon (KR); Jong Sick Choi, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 433 days.

(21) Appl. No.: 11/138,218

(22) Filed: May 25, 2005

(65) Prior Publication Data

US 2006/0006788 A1 Jan. 12, 2006

(30) Foreign Application Priority Data

Jun. 29, 2004 (KR) ..... 10-2004-0049715

(51) Int. Cl.
*G09G 3/10* (2006.01)

(52) U.S. Cl. ..... 315/169.4; 313/336; 313/495; 313/497

(58) Field of Classification Search .. 315/169.1–169.4; 313/336, 306, 309, 311, 495–500; 345/75.2
See application file for complete search history.

(56) References Cited

U.S. PATENT DOCUMENTS 5,534,744 A * 7/1996 Leroux et al. ..... 313/497
5,717,279 A * 2/1998 Imura ..... 313/336
6,060,841 A * 5/2000 Niiyama et al. ..... 315/169.3
6,323,831 B1 * 11/2001 Ono et al. ..... 345/75.2
6,538,391 B1 * 3/2003 Suzuki et al. ..... 315/169.3
6,963,171 B2 * 11/2005 Sagawa et al. ..... 315/169.1
7,097,530 B2 * 8/2006 Katakura et al. ..... 445/50
2004/0113178 A1 * 6/2004 Wilson ..... 257/209

FOREIGN PATENT DOCUMENTS

| | | |
|---|---|---|
| JP | 10-340666 | 12/1998 |
| JP | 2001-043789 | 2/2001 |
| KR | 1997-0017774 | 4/1997 |
| KR | 1999-0075993 | 10/1999 |
| KR | 10-0289638 | 2/2001 |

* cited by examiner

*Primary Examiner*—Douglas W. Owens
*Assistant Examiner*—Ephrem Alemu
(74) *Attorney, Agent, or Firm*—Christie, Parker & Hale, LLP

(57) ABSTRACT

An electron emission device and an electron emission display, in which a driving electrode is protected from being damaged when an overcurrent instantly flows therein. The electron emission device includes a first driving electrode disposed on a plate, a second driving electrode disposed on the plate and insulated from the first driving electrode, and an electron emission portion connected to the first driving electrode. The electron emission portion emits electrons in response to a voltage difference between the first driving electrode and the second driving electrode. The second driving electrode has at least two separate portions, and the at least two separate portions are coupled to each other by at least one band having a predetermined width adapted to electrically isolate at least one portion of the second driving electrode from the electron emission portion when an overcurrent is applied between the second driving electrode and the electron emission portion.

20 Claims, 6 Drawing Sheets

ELECTRON EMISSION DEVICE AND ELECTRON EMISSION DISPLAY USING THE SAME

CROSS-REFERENCE TO RELATED APPLICATIONS

This application claims priority to and the benefit of Korean Patent Application No. 10-2004-0049715, filed Jun. 29, 2004, in the Korean Intellectual Property Office, the entire content of which is incorporated herein by reference.

BACKGROUND

1. Field of the Invention

The present invention relates to an electron emission device and an electron emission display using the same, and more particularly, to an electron emission device and an electron emission display, in which a driving electrode is protected from being damaged when an overcurrent instantly flows therein.

2. Discussion of Related Art

Generally, an electron emission device is classified into a hot cathode type or a cold cathode type, wherein the hot cathode type and the cold cathode type employ a hot cathode and a cold cathode, respectively, as an electron emission source.

A cold cathode type electron emission device includes a structure such as a field emitter array (FEA), a surface conduction emitter (SCE), a metal insulator metal (MIM), a metal insulator semiconductor (MIS), a ballistic electron surface emitting (BSE), etc.

The electron emission device having the FEA structure is based on a principle that a material having a low work function and a high β-function is employed as an electron emission source and emits electrons due to electric field difference in a vacuum. Such an FEA electron emission device includes the electron emission source having a sharp pointed tip and made of a carbon material or a nano material.

The electron emission device having the SCE structure is provided with an electron emission portion, in which two electrodes are opposite to each other and formed on a plate and a conductive layer is formed between the two electrodes, wherein the conductive layer is formed with a minute crack or gap, thereby forming the electron emission portion. Such an SCE electron emission device is based on a principle that the electron emission portion formed by the minute crack or gap emits electrons when voltage is applied between two electrodes and an electrical current flows through a surface of the conductive thin layer.

The electron emission device having the MIM or MIS structure includes an electron emission portion having a metal-insulator-metal structure or a metal-insulator-semiconductor structure and is based on a principle that electrons are emitted from a metal or a semiconductor of high electric potential and accelerated toward a metal of low electric potential when a voltage is applied between the metal and the metal or between the metal and the semiconductor.

The electron emission device having the BSE structure is based on a principle that electrons travel without sputtering when the size of a semiconductor is smaller than a mean free path of the electrons contained in the semiconductor. Such a BSE electron emission device includes an electron supplying layer made of a metal or a semiconductor and formed on an ohmic electrode, an insulator formed on the electron supplying layer, and a thin metal layer formed on the insulator, so that the electrons are emitted when a voltage is applied between the ohmic electrode and the thin metal layer.

The foregoing electron emission devices are employed in an electron emission display, various backlights, an electron beam for lithography, etc. In the case of the electron emission display, there are provided an electron emission device including an electron emission region for emitting electrons, and an image-displaying region in which the emitted electrons collide with a fluorescent layer and thus emit light. Generally, an electron emission display includes a plurality of electron emission devices formed on a first plate, a driving electrode for controlling the electron emission devices to emit the electrons, and a fluorescent layer and an electrode connected to the fluorescent layer to efficiently accelerate the electrons toward the fluorescent layer.

However, in the foregoing electron emission display, a distance between the driving electrodes or a distance between the driving electrode and the electron emission portion is just a few μm through a few scores of μm, so that they are likely to be short-circuited by foreign material or arcing. To solve this problem, various devices have been proposed. For example, there is a conventional electron emission device disclosed in Korean Patent No. 10-289638.

FIG. 1 is a plan view that schematically illustrates a conventional electron emission device, and FIG. 2 is a cross-sectional view of the conventional electron emission device, taken along the line A-A in FIG. 1.

The conventional electron emission device of FIG. 1 includes a plate 1, a cathode interconnection line 2 formed on the plate 1, an island electrode 3, first and second resistive layers 4 and 5 formed on the island electrode 3 in sequence, a gate electrode 8 insulated from the second resistive layer 5 by an insulating layer 6, and a micro tip 7 connected to the first resistive layer 4 and formed within an opening of the insulating layer 6.

In this electron emission device, the first and second resistive layers 4 and 5 are different in resistance from each other and layered as shown in FIG. 2. Hence, when an overvoltage is applied to the micro tip 7, the layered structure of the first and second resistive layers 4 and 5 is likely to be broken off, thereby isolating the island electrode 3 from the cathode interconnection line 2. That is, when the gate electrode 8 and the micro tip 7 are short-circuited, the short-circuited, it is possible to separate only the island electrode 3 electrically connected to the micro tip 7 from the cathode interconnection line 3.

However, the conventional electron emission device has a relatively complicated structure, so that production cost thereof is relatively high and it still has a problem in reliability.

SUMMARY OF THE INVENTION

Accordingly, it is an aspect of the present invention to provide an electron emission device which has a simple structure and prevents driving electrodes from being short-circuited.

Another aspect of the present invention is to provide an electron emission device and an electron emission display, in which defects are decreased and reliability thereof is enhanced.

Still another aspect of the present invention is to provide an electron emission device and an electron emission display, which have a simple fabricating process and decrease production cost.

In an exemplary embodiment according to the present invention, an electron emission device including a first driving electrode, a second driving electrode and an electron emission portion, is provided. The first driving electrode is disposed on a plate. The second driving electrode is disposed on the plate and insulated from the first driving electrode. The second driving electrode has at least two separate portions. The electron emission portion is connected to the first driving electrode and emits electrons in response to a voltage difference between the first driving electrode and the second driving electrode. The at least two separate portions of the second driving electrode are coupled to each other by at least one band having a predetermined width adapted to electrically isolate at least one of the at least two separate portions of the second driving electrode from the electron emission portion when an overcurrent is applied between the second driving electrode and the electron emission portion.

The at least one band and the second driving electrode may be made of a same material or different materials. The at least one band and the second driving electrode may be made of different materials, and the at least one band may include a material having a lower melting point than that of the second driving electrode.

The at least one band may be thinner than the at least two separate portions of the second driving electrode.

The electron emission device may further include an insulating layer formed on the first driving electrode and through which at least a portion of the electron emission portion is exposed. The first driving electrode and the second driving electrode may be spatially insulated from each other.

In another exemplary embodiment according to the present invention, an electron emission device including a first driving electrode, a second driving electrode and an electron emission portion, is provided. The first driving electrode is disposed on a plate. The second driving electrode is disposed on the plate and insulated from the first driving electrode. The second driving electrode includes at least a first conductive layer and a second conductive layer, at least one of the first and second conductive layers having at least two separate portions. The electron emission portion is connected to the first driving electrode and emits electrons in response to a voltage difference between the first driving electrode and the second driving electrode. The at least two separate portions of the at least one of the first and second conductive layers are coupled to each other by at least one band having a predetermined width adapted to electrically isolate at least one of the at least two separate portions of the second driving electrode from the electron emission portion when an overcurrent is applied between the second driving electrode and the electron emission portion.

The at least one band may be formed at the first conductive layer, the second conductive layer, or both the first and second conductive layers. The at least one band may be formed at the first conductive layer, and the first conductive layer may include a material having a lower melting point than that of the second conductive layer.

The first conductive layer may include a material selected from Ag, Al, Zn, Mg, Sr, etc., or any suitable alloy thereof, and the second conductive layer may include a material selected from Au, Cu, Fe, Th, Cr, Mo, Ni, Ta, W, Zr, Pt, etc., or any suitable alloy thereof.

In yet another exemplary embodiment according to the present invention, an electron emission display including a first plate and a second plate, at least one first driving electrode and at least one second driving electrode, an electron emission portion, and an image realization portion, is provided. The first plate and the second plate are disposed to be opposite to each other, and the at least one first driving electrode and the at least one second driving electrode are disposed to be insulated from each other on the first plate. The electron emission portion is connected to the at least one first driving electrode and for emitting electrons in response to a voltage difference between the at least one first driving electrode and the at least one second driving electrode. The image realizing portion is formed on the second plate and displays a picture based on the electrons emitted from the electron emission portion. The at least one second driving electrode has at least two separate portions, and the at least two separate portions are coupled to each other by at least one band having a predetermined width adapted to electrically isolate at least one of the at least two separate portions of the at least one second driving electrode from the electron emission portion when an overcurrent is applied between the at least one second driving electrode and the electron emission portion.

The at least one first driving electrode and the at least one second driving electrode may cross each other and define a pixel, and the pixel may be provided with at least two electron emission portions.

The at least one band and the at least one second driving electrode may be made of a same material or different materials. The at least one band and the at least one second driving electrode may be made of different materials, and the at least one band may be made of a material having a lower melting point than that of the at least one second driving electrode.

BRIEF DESCRIPTION OF THE DRAWINGS

These and other aspects and features of the present invention will become apparent and more readily appreciated from the following description of the exemplary embodiments, taken in conjunction with the accompanying drawings of which.

DETAILED DESCRIPTION

In the following detailed description, certain exemplary embodiments of the present invention are shown and described, simply by way of illustration. As will be realized, the described exemplary embodiments can be modified in various different ways, all without departing from the spirit or scope of the present invention. Accordingly, the drawings and description are to be regarded as illustrative in nature, and not restrictive.

(Electron Emission Device)

Figure 1:
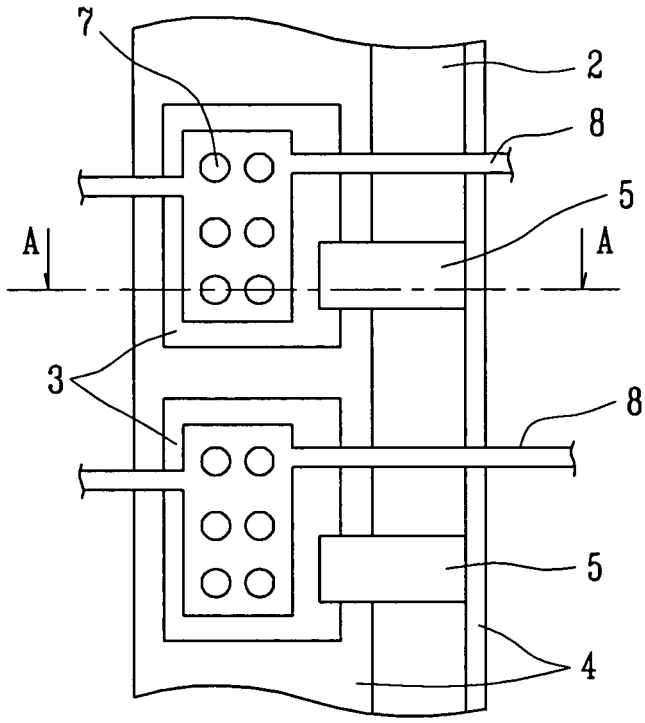
FIG.1 (PRIOR ART)
FIG. 1 is a plan view schematically illustrating a conventional electron emission device.
Figure 2:
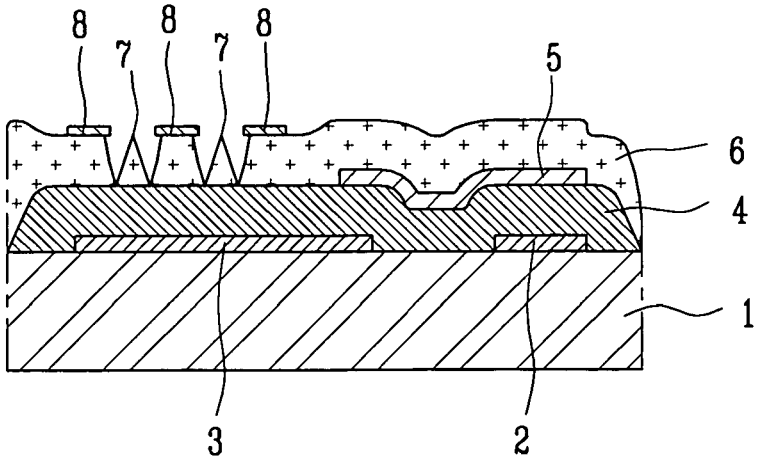
FIG.2 (PRIOR ART)
FIG. 2 is a cross-sectional view of the conventional electron emission device, taken along the line A-A in FIG. 1.
Figure 3A:
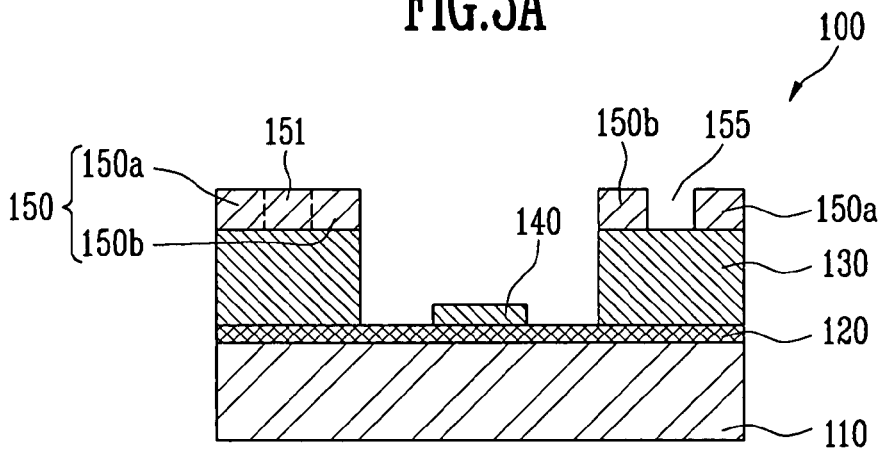
FIG. 3A is a cross-sectional view of an electron emission device according to a first exemplary embodiment of the present invention.
Figure 3B:
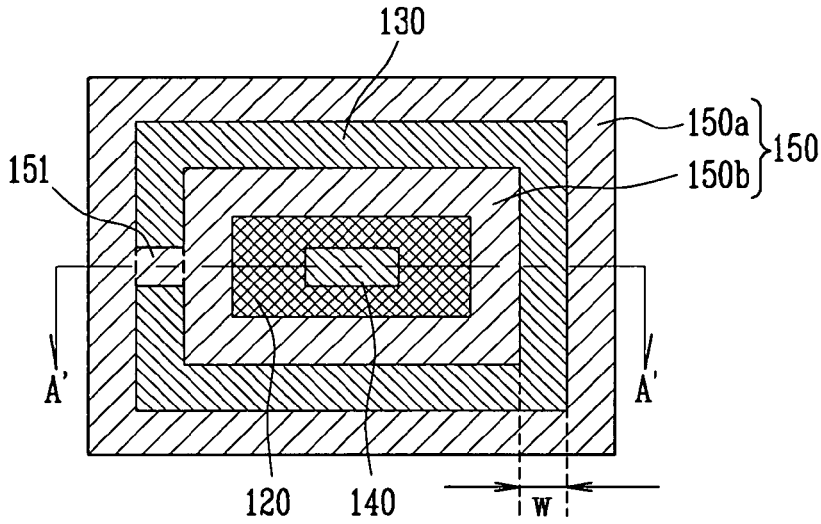
FIG. 3B is a plan view of the electron emission device of FIG. 3A.

FIG. 3A is a cross-sectional view of an electron emission device 100 according to a first exemplary embodiment of the present invention, and FIG. 3B is a plan view of the electron emission device of FIG. 3A, wherein FIG. 3A is a cross-sectional view of FIG. 3B, taken along the line A'-A'.

Referring to FIG. 3A, the electron emission device 100 according to the first exemplary embodiment of the present invention includes a first driving electrode 120 having a predetermined shape on a plate 110, a second driving electrode 150 insulated from the first driving electrode 120, and an electron emission portion 140 connected to the first driving electrode 120. Here, a voltage difference between the first driving electrode 120 and the second driving electrode 150 causes the electron emission portion 140 to emit electrons.

To isolate at least one portion of the second driving electrode 150 from the electron emission portion 140 when overvoltage is applied between the second driving electrode 150 and the electron emission portion 140, at least one portion 150*b* of the second driving electrode 150 is connected to another portion 150*a* of the second driving electrode 150 through at least one band 151 having a predetermined width. Here, the band 151 functions as a fuse.

The band 151 is typically made of the same material as the second driving electrode 150, but may also be made of other material different from that of the second driving electrode 150. Further, the number of the band 151 is not limited to one and multiple bands may be used.

Further, the band 151 is not limited to having a band shape and may have various different shapes as long as it can be broken off when the overvoltage is applied between the second driving electrode 150 and the electron emission portion 140.

Further, to easily isolate at least one portion 150*b* of the second driving electrode 150 adjacent to the electron emission portion 140 like an island, the second driving electrode 150 has a trench 155 except for the band 151.

Figure 3C:
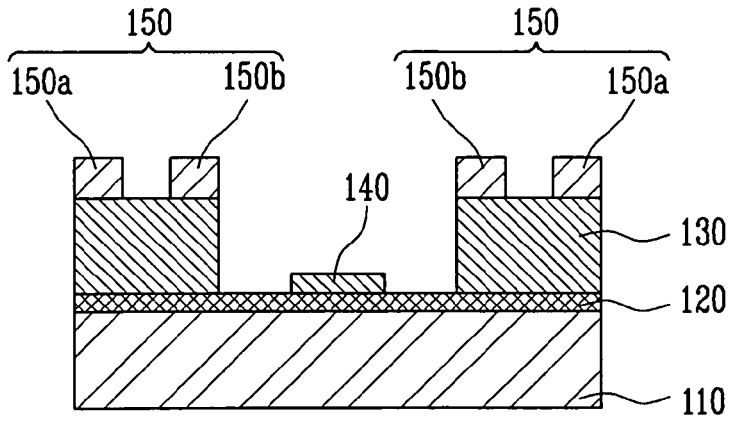
FIG. 3C is a cross-sectional view showing that the electron emission device of FIG. 3A is partially broken.

With this configuration, when an overcurrent is applied between the electron emission portion 140 and the second driving electrode 150, the band 151 is broken off without withstanding the overcurrent because resistance is relatively high in the band 151 of the second driving electrode 150. FIG. 3C illustrates that the second driving electrode 150 is partially broken. Further, the band 151 should be thin as compared to other portions of the second driving electrode 150. Accordingly, as the band 151 is relatively thin, the resistance thereof is effectively increased.

In the case where the band 151 is made of a different material from that of the second driving electrode 150, the band 151 should be made of material having a melting point lower than that of the second driving electrode 150.

In other words, the band 151 should be made of material having a relatively low melting point such as, without being limited to, Ag, Al, Zn, Mg, Sr, etc., or any suitable alloy thereof. On the other hand, the second driving electrode 150 should be made of material having a higher melting point than that of the band 151, such as, without being limited to, Au, Cu, Fe, Th, Cr, Mo, Ni, Ta, W, Zr, Pt, etc., or any suitable alloy thereof. The thickness of the second driving electrode 150 should be a few hundreds of μm through a few μm. Each melting point of the material is shown in the following <Table 1>.

TABLE 1

| Material | Melting point (° C.) | Material | Melting point (° C.) |
|---|---|---|---|
| Ag | 961 | Mg | 651 |
| Al | 660 | Mo | 2620 |
| Au | 1063 | Ni | 1455 |
| Cu | 1083 | Sr | 800 |
| Fe | 1535 | Ta | 2850 |
| Th | 1845 | W | 3370 |
| Zn | 420 | Zr | 1900 |
| Cr | 1890 | Pt | 1774 |

Further, various different types of materials can be used to make the plate 110. By way of example, the plate 110 can be made of glass or glass decreased in impurities such as Na or the like. The plate 110 may also be made of a silicon plate formed with an insulating layer such as $SiO_2$ or the like formed thereon, a ceramic plate, etc.

The first driving electrode 120 is formed by depositing metal such as Cr, Al, Mo, Cu, Ni, Au, etc. with a thickness of 1,000 μm through 10,000 μm-using conventional depositing techniques. As necessary, the first driving electrode 120 can be formed by a transparent conductive layer such as indium tin oxide (ITO), ZnO, etc. having a thickness of 1,000 μm through 2,000 μm. The first driving electrode 120 should be made of a transparent conductive layer, which is especially useful when a lithography process using a rear exposure is employed during the manufacturing process.

The insulating layer 130 can be formed using conventional techniques for forming insulating layers, such as, for example, a screen printing method, a sputtering method, a chemical vapor deposition (CVD) method or a vapor deposition method, to have a thickness ranging from a few nm through scores of μm. The insulating layer 130 should be made of $SiO_2$, $SiN_x$, etc.

The second driving electrode 150 can be formed using conventional depositing techniques by depositing the aforementioned metals or alloy thereof with a thickness of a few hundreds of μm through a few μm. Further, the second driving electrode 150 can be formed concurrently and/or integrally with the band 151.

The electron emission portion 140 has a tip structure mainly including Mo, Si, etc., and is made of a carbon material such as carbon nano tube (CNT), graphite, diamond, diamond like carbon (DLC), or any suitable combination thereof, a nano-sized material such as a nano tube, nano fiber and a nano wire of Si, SiC, etc. The electron emission portion 140 should be made of CNT in exemplary embodiments of the present invention.

In the case where a plurality of electron emission devices, such as the electron emission device described above, functions as one electron source, when an overcurrent is applied between the electron emission portion and the second driving electrode of one electron emission device among the plurality of electron emission devices, only the one electron emission device relevant to the overcurrent stops operating, thereby protecting the other irrelevant electron emission devices from being damaged. On the other hand, in the case of the electron emission display employing the conventional electron emission device, when one electron emission portion and the driving electrode adjacent to the electron emission portion are short-circuited, there arises a problem in that the whole line relevant to the foregoing driving electrode does not normally operate. However, in the case of the electron emission display employing the electron emission device according to an embodiment of the present invention, the above problem is solved because not the whole line but only the relevant electron emission device does not normally operate.

Figure 4A:
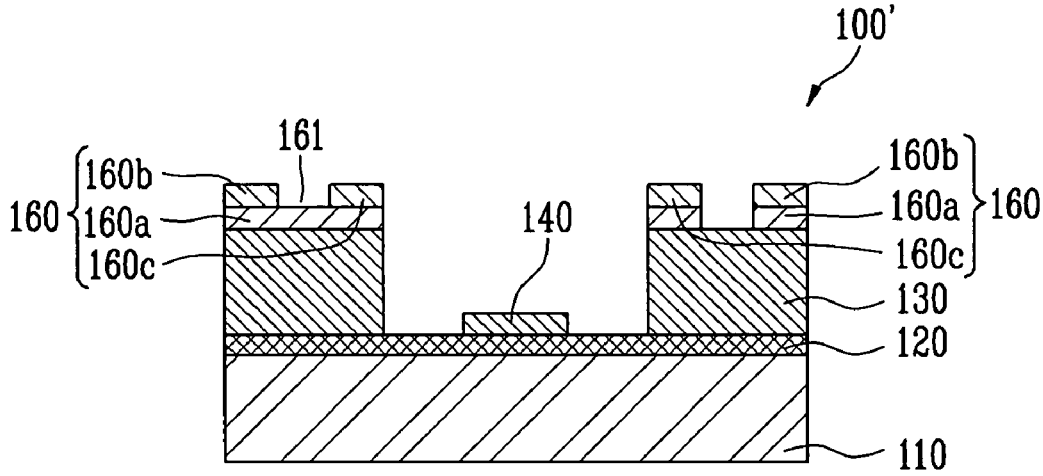
FIG. 4A is a cross-sectional view of an electron emission device according to a second exemplary embodiment of the present invention.
Figure 4B:
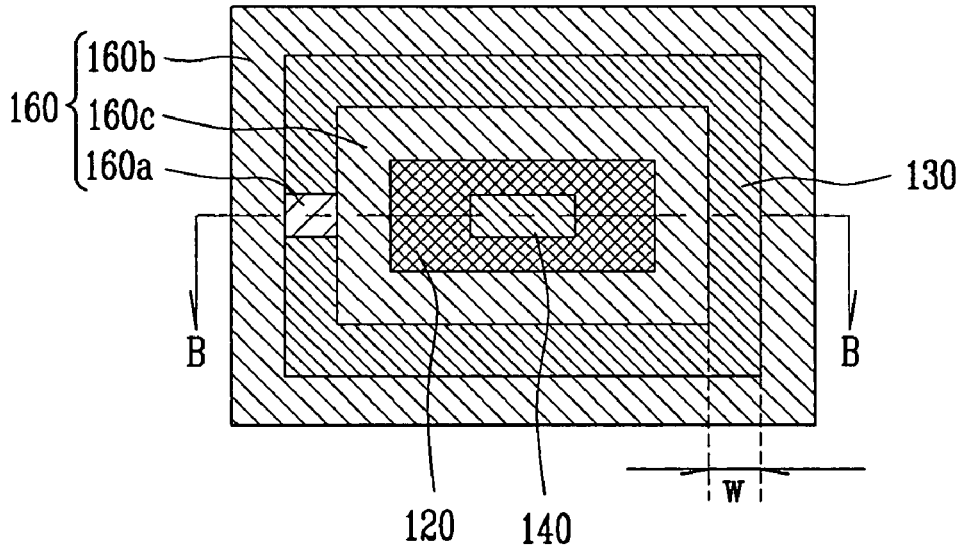
FIG. 4B is a plan view of the electron emission device of FIG. 4A.

FIG. 4A is a cross-sectional view of an electron emission device 100' according to a second exemplary embodiment of the present invention, and FIG. 4B is a plan view of the electron emission device of FIG. 4A, wherein FIG. 4A is the cross-sectional view of the electron emission device, taken along the line B-B of FIG. 4B.

Referring to FIG. 4A, the electron emission device 100' according to the second exemplary embodiment of the present invention includes a first driving electrode 120 having a predetermine shape on a plate 110, a second driving electrode 160 insulated from the first driving electrode 120, and an electron emission portion 140 connected to the first driving electrode 120. Here, a voltage difference between the first driving electrode 120 and the second driving electrode 160 causes the electron emission portion 140 to emit electrons.

The second driving electrode 160 includes at least a first conductive layer 160*a*, and a second conductive layer 160*b*, 160*c*. The first conductive layer 160*a* and the second conductive layer 160*b* have the same structure except for a band region 161. That is, in the band region 161, only the first conductive layer 160*a*, only the second conductive layer 160*b*, 160*c*, or all of the first and second conductive layers 160*a*, 160*b*, 160*c* may be shaped like a band. FIG. 4 illustrates that only the first conductive layer 160*a* has a band shape. As can be seen in FIG. 4, the width of the band region 161 is less than that of the second electrode 160 and it has a relatively high resistance.

The band 161 allows the second conductive layer 160*c* adjacent to the electron emission portion 140 to be isolated like an island. The first conductive layer 160*a* and the second conductive layer 160*b* are made of the same material or different materials from each other. The first conductive layer 160*a* and the second conductive layer 160*b* should be made of different materials from each other. Here, the second driving electrode 160 has a two-layered structure, but may have three or more layered structure. Further, in the case where the second driving electrode 160 has a three-layered structure, the band region 161 may be formed in one layer, two layers, or three layers.

FIG. 4A illustrates that the first conductive layer 160*a* and the second conductive layer 160*b*, 160*c* of the second driving electrode 160 are layered on the plate 110 in sequence. Alternatively however, the second conductive layer 160*b*, 160*c* and the first conductive layer 160*a* of the second driving electrode 160 may be layered on the plate 110 in sequence, wherein the band region 161 is included in the second conductive layer 160*b*, 160*c*.

The first conductive layer 160*a* should be made of a material having a melting point lower than that of the second conductive layer 160*b*, 160*c*, for example, metal. Further, the first conductive layer 160*a* and the second conductive layer 160*b*, 160*c* should be different in a melting point of 500° C. through 2,000° C. The difference in the melting point between the first conductive layer 160*a* and the second conductive layer 160*b*, 160*c* is properly determined in consideration of the level of overvoltage, the shape of the second driving electrode 160, the thickness of the respective first and second conductive layers 160*a*, 160*b*, 160*c*, etc. The larger the difference in the melting point between the first conductive layer 160 and the second conductive layer 160*b*, 160*c* is, the more effective it may be.

The first conductive layer 160*a* should be made of material having a relatively low melting-point such as, without being limited to, Ag, Al, Zn, Mg, Sr, etc., or any suitable alloy thereof. On the other hand, the second conductive layer 160*b*, 160*c* should be made of material having a relatively high melting point such as, without being limited to, Au, Cu, Fe, Th, Cr, Mo, Ni, Ta, W, Zr, Pt, etc., or any suitable alloy thereof. The thickness of the second conductive layer 160*b*, 160*c* should be a few hundreds of μm through a few μm.

With this configuration, when an overcurrent is applied between the electron emission portion 140 and the second driving electrode 160, the band region 161 of the second driving electrode 160 is broken off without withstanding the overcurrent because resistance is relatively high in the band region 161. Thus, when the overcurrent flows in the second driving electrode 160, the band region 161 is broken off, so that the electron emission portion 140 is isolated from the second conductive layer 160*b* of the second driving electrode 160.

(Electron Emission Display)

Figure 5:
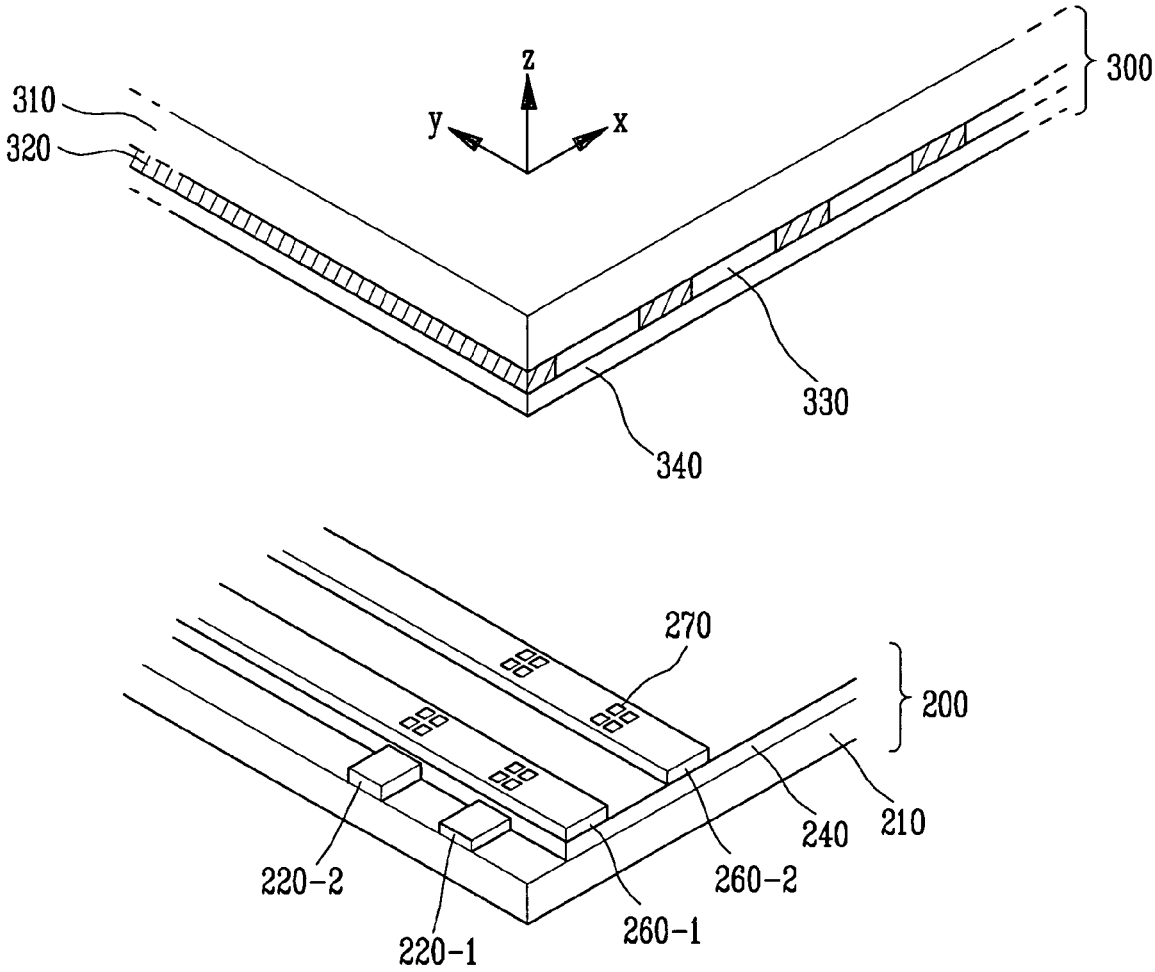
FIG. 5 is a schematic perspective view of an electron emission display using the electron emission device according to the first exemplary embodiment of the present invention.

FIG. 5 is a schematic perspective view of an electron emission display using the electron emission device according to an exemplary embodiment (e.g., the electron emission device 100 of FIG. 3A, the electron emission device 100' of FIG. 4A or any other suitable exemplary electron emission device) of the present invention.

The electron emission display according to the exemplary embodiment of the present invention includes a first plate 200 and a second plate 300, which are opposite to and spaced apart from each other and sealed to form a vacuum. At last one cathode electrode 220-1, 220-2, . . . and at least one gate electrode 260-1, 260-2, . . . are arranged on the first plate 200, forming a matrix shape and defining pixels. Referring to FIG. 5, the gate electrodes 260-1, 260-2, . . . and the cathode electrodes 220-1, 220-2, . . . are respectively shaped like stripes, periodically arranged to form a pixel array, and employed for transmitting a signal from the outside to each pixel.

Further, each pixel is formed with a plurality of openings. Each opening is provided in an insulating layer 240 and exposes an electron emission portion connected with the cathode electrode 220-1, 220-2, . . . to a fluorescent layer 330 of the second plate 300. The second plate 300 includes a plate 310, at least one anode electrode 340 formed on the plate 310, and the fluorescent layer 330 periodically formed, e.g., as a stripe shape in at least one surface of the anode electrode 340. The anode electrode 340 can be formed by a transparent electrode such as indium tin oxide (ITO), or a thin metal film. Further, the anode electrode 340 can be formed by a single electrode, a stripe shaped electrode, or a partitioned electrode. The fluorescent layer 330 can have a stripe shape or a dotted shape. Additionally, an optical shielding film 320 may be formed between the fluorescent layers 330.

Further, the first plate 200 and the second plate 300 are supported to keep a space therebetween by a well-known supporting structure, e.g., spacers. The number of the electron emission portions corresponding to one fluorescent layer 340 for an R (red) pixel, a G (green), or a B (blue) pixel is not limited. For example, FIG. 5 illustrates that four electron emission portions 270 are provided corresponding to one pixel.

Figure 6:
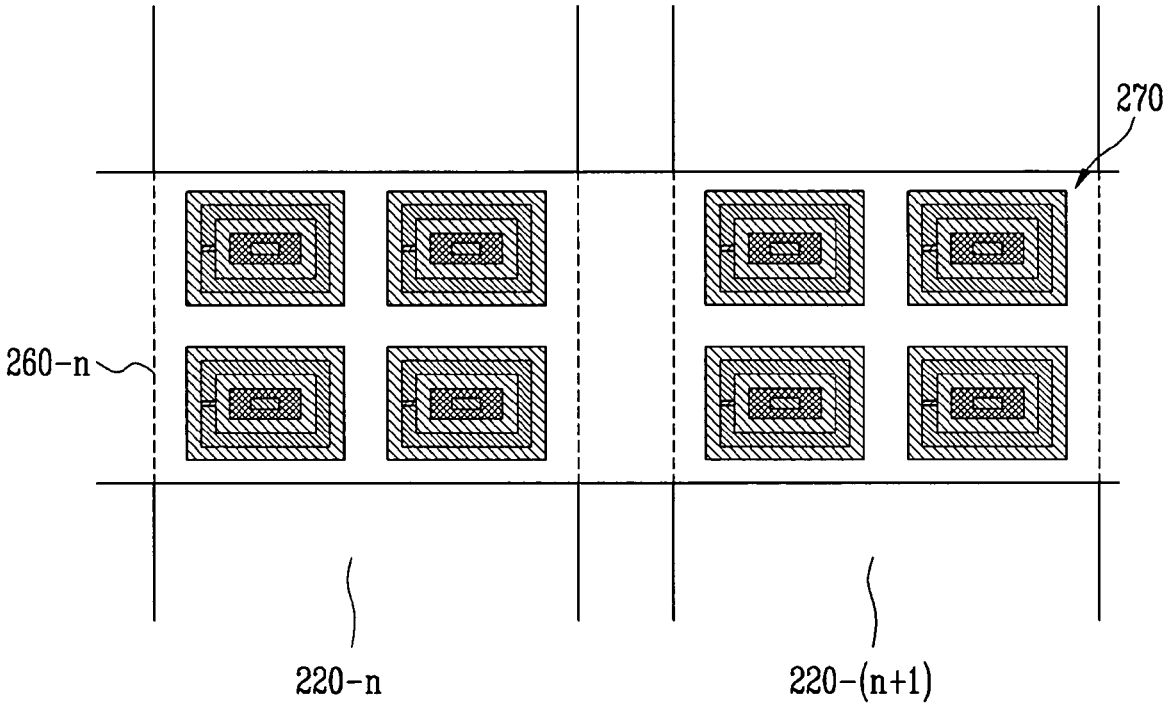
FIG. 6 is an enlarged plan view of a portion of the electron emission display of FIG. 5.

FIG. 6 is an enlarged plan view of a portion of the electron emission display having four electron emission portions 270 per pixel in FIG. 5. Referring to FIG. 6, the cathode electrodes 220-*n*, 220-(*n*+1) among the plurality of cathode electrodes, and the gate electrode 260-*n* are arranged like a matrix and define pixels, wherein each pixel includes four electron emission devices 270. Further, each electron emission device includes at least one band to isolate a portion of the gate electrode 260-*n* adjacent to the electron emission portion like an island.

With this configuration, in one among four electron emission devices 270 provided in one pixel, when one electron emission device is applied with an overcurrent due to a short-circuit between the gate electrode and the electron emission portion, only the relevant electron emission device is isolated from the gate electrode. Thus, the electron emission device relevant to the overcurrent is isolated, so that the whole line of the gate electrode is not damaged and becomes defective.

Two or more electron emission devices or portions should be configured to correspond to one pixel (one fluorescent layer). Accordingly, as two or more electron emission portions are configured to correspond to one pixel, even though one among the electron emission portions does not normally operate, the pixel is normally operated by other electron emission portions.

Further, as an example of a voltage level allowed to be applied to the electron emission display, a voltage level of 10V through 120V is applied to the gate electrode, and a voltage level of −120 through −10 is applied to the cathode electrode. Further, a voltage level of 1 kV through a few KV is applied to the anode electrode, thereby accelerating the electrons emitted from the electron emission portions.

Figure 7A:
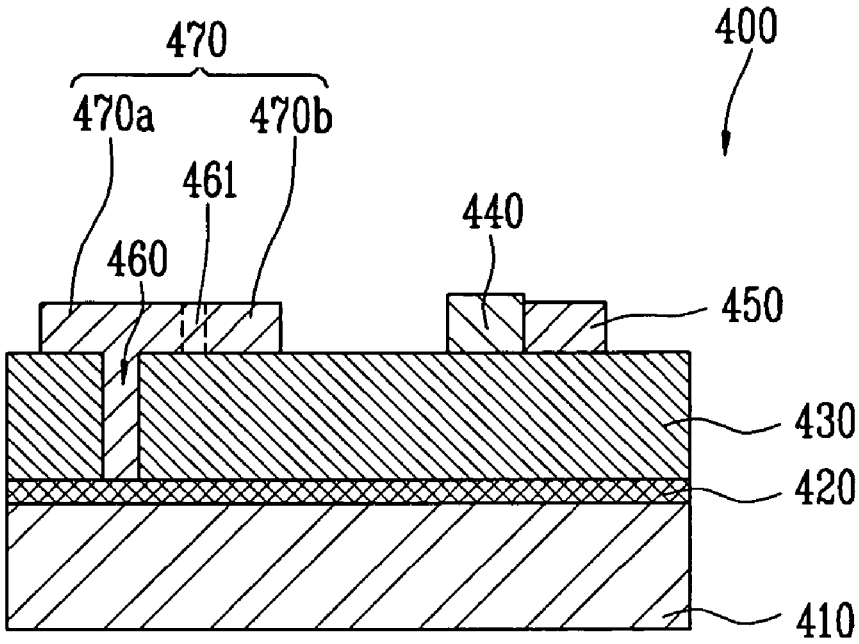
FIG. 7A is a cross-sectional view of an electron emission device according to a third exemplary embodiment of the present invention.
Figure 7B:
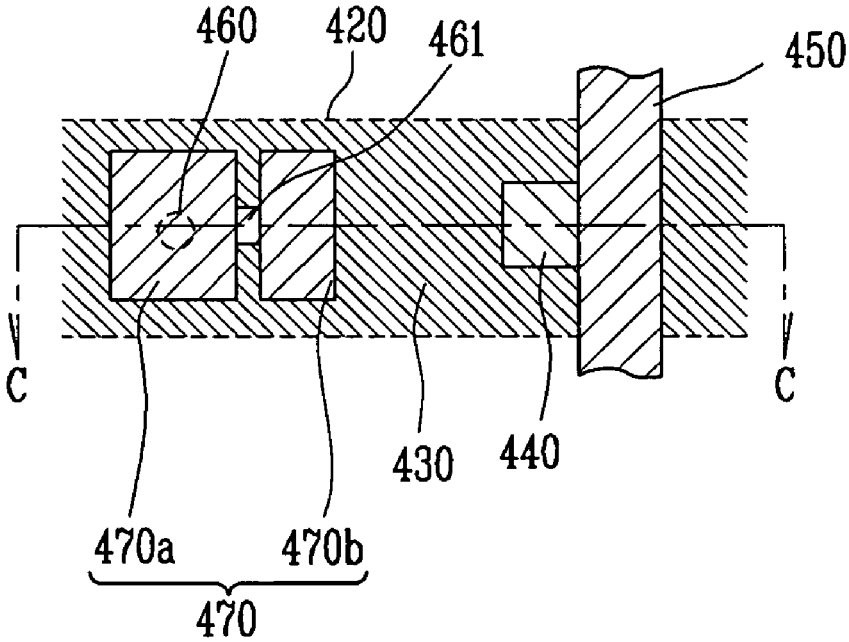
FIG. 7B is a plan view of the electron emission device of FIG. 7A.

FIG. 7A is a cross-sectional view of an electron emission device 400 according to a third exemplary embodiment of the present invention, and FIG. 7B is a plan view of the electron emission device of FIG. 7A, wherein FIG. 7A is the cross-sectional view of the electron emission device, taken along the line C-C in FIG. 7B.

Referring to FIGS. 7A and 7B, the electron emission device 400 includes a plate 410, a first driving electrode 450 formed on the plate 410 and having a predetermined shape, a second driving electrode 470 disposed while being insulated from the first driving electrode 450, and an electron emission portion 440 connected to the first driving electrode 450. Here, a difference in voltage applied between the first driving electrode 450 and the second driving electrode 470 causes the electron emission portion 440 to emit electrons. To isolate at least a portion of the second driving electrode 470 from the electron emission portion 440 when an overcurrent is applied between the second driving electrode 470 and the electron emission portion 440, at least one portion 470*b* is provided with at least one band 461 having a predetermined width to be separated from the other portion 470*a* of the second electrode 470. The predetermined width of the band 461 is less than the width of the second driving electrode 470.

In the electron emission device of FIG. 3A, the first driving electrode formed on the plate and connected with the electron emission portion is vertically insulated from the second driving electrode, leaving the insulating layer between the first driving electrode and the second driving electrode. On the other hand, in the electron emission device of FIG. 7A, the first driving electrode 450 and the second driving electrode 470 are on the same layer (i.e., the insulating layer 430) but are spatially insulated from each other. As it can be seen in FIG. 7A, for example, the first driving electrode 450 and the second driving electrode 470 are spatially separated from each other such that they are not electrically connected together.

With this configuration, when an overcurrent is applied between the electron emission portion 440 and the second driving electrode 470, the band 461 of the second driving electrode 470 is broken off without withstanding the overcurrent because resistance is relatively high in the band 461 of the second driving electrode 470. Thus, when the overcurrent flows in the second driving electrode 470, the band region 461 is broken off, so that the electron emission portion 440 is isolated from the portion 470*a* of the second driving electrode 470. That is, the second driving electrode 470 is separated into two portions 470*a*, 470*b* by breaking the band 461 off.

In the electron emission device of FIGS. 7A and 7B, the first driving electrode 450 and the second driving electrode 470 are made of the same metal material as a single layer. However, the first driving electrode 450 and the second driving electrode 470 may be made of different materials, respectively, and may be formed as a plurality of layers. Further, in the electron emission device of FIGS. 7A and 7B, the second driving electrode 470 is connected to an auxiliary electrode 420 through a via-hole 460 formed through the insulating layer 430. However, the first driving electrode 450 may also be directly connected to the auxiliary electrode 420.

In an electron emission display including the electron emission device of FIG. 7A, a second plate has the same configuration as the second plate 300 (refer to FIG. 5), and a first plate may vary in configuration. For example, at least one auxiliary electrode 420 and at least one first driving electrode 450 are configured to have a matrix shape to form a pixel, wherein the insulating layer 430 keeps the auxiliary electrode 420 and the first driving electrode 450 insulated from each other. Further, the auxiliary electrode 420 is connected to the second driving electrode 470 through the via-hole 460 formed on the insulating layer 430.

The second driving electrode 470 is formed with at least one band 461. The band 461 is used for isolating the portion 470*b* of the second driving electrode 470 adjacent to the electron emission portion 440 like an island (refer to FIG. 7B). Further, the second driving electrode 470 is connected to the auxiliary electrode 420 through the via-hole 460 formed through the insulating layer 430. With this configuration, the first driving electrode 450 and the second driving electrode 470 cross each other, leaving the insulating layer 430 therebetween. Such a crossing structure can function as an interconnection line for transmitting a signal when the electron emission device is used in the electron emission display.

Each pixel includes at least one electron emission device. Further, each electron emission device includes a band to isolate the portion of the second driving electrode 470 like an island from the electron emission portion. In this structure, when the overcurrent is supplied to one electron emission device provided in the pixel due to the short-circuit between the second driving electrode and the electron emission portion, the band functions as a fuse, that is, the band is broken off, thereby isolating the electron emission device. Thus, the whole gate electrode line does not become defective.

In the foregoing embodiment, the electron emission portion is made of a material that emits electrons when electric field is applied to the electron emission portion, and is controlled to emit the electrons by the driving electrodes. However, the electron emission device is not limited thereto and may vary.

As described above, the present invention provides an electron emission device which has a simple structure and prevents driving electrodes from being short-circuited. Further, the present invention provides an electron emission device and an electron emission display, in which a defect is decreased and reliability thereof is enhanced. Still further, the present invention provides an electron emission device and an electron emission display, which have a simple fabricating process and decrease production cost.

Although certain exemplary embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission device comprising:

a first driving electrode disposed on a plate;

a second driving electrode disposed on the plate and insulated from the first driving electrode, the second driving electrode having at least two separate portions; and an electron emission portion connected to the first driving electrode and for emitting electrons in response to a voltage difference between the first driving electrode and the second driving electrode, wherein the at least two separate portions of the second driving electrode are coupled to each other by at least one band having a predetermined width adapted to isolate at least one of the at least two separate portions of the second driving electrode from the electron emission portion when an overcurrent is applied between the second driving electrode and the electron emission portion.

2. The electron emission device according to claim 1, wherein the at least one band and the second driving electrode are made of a same material or different materials.

3. The electron emission device according to claim 2, wherein the at least one band and the second driving electrode are made of different materials, and the at least one band includes a material having a lower melting point than that of the second driving electrode.

4. The electron emission device according to claim 1, wherein the at least one band is thinner than the at least two separate portions of the second driving electrode.

5. The electron emission device according to claim 1, further comprising an insulating layer formed on the first driving electrode and through which at least a portion of the electron emission portion is exposed.

6. The electron emission device according to claim 1, wherein the first driving electrode and the second driving electrode are spatially insulated from each other.

7. The electron emission device according to claim 1, further comprising an auxiliary electrode connected to the first driving electrode or the second driving electrode.

8. The electron emission device according to claim 7, wherein the auxiliary electrode is disposed on the plate, wherein the first and second electrodes are formed on an insulating layer disposed between the auxiliary electrode and the first and second electrodes, and wherein the first driving electrode or the second driving electrode is connected to the auxiliary electrode through a via hole formed in the insulating layer.

9. The electron emission device according to claim 1, wherein the at least two separate portions of the second driving electrode include a first portion formed above and around a periphery of the electron emission portion, and a second portion surrounding the first portion, wherein the second portion is the at least one of the at least two separate portions that is isolated from the electron emission portion when the overcurrent is applied between the second driving electrode and the electron emission portion.

10. An electron emission device comprising:

a first driving electrode disposed on a plate;

a second driving electrode disposed on the plate and insulated from the first driving electrode, the second driving electrode comprising at least a first conductive layer and a second conductive layer, at least one of the first and second conductive layers having at least two separate portions; and an electron emission portion connected to the first driving electrode and for emitting electrons in response to a voltage difference between the first driving electrode and the second driving electrode, wherein the at least two separate portions of the at least one of the first and second conductive layers are coupled to each other by at least one band having a predetermined width adapted to electrically isolate at least one of the at least two separate portions of the second driving electrode from the electron emission portion when an overcurrent is applied between the second driving electrode and the electron emission portion.

11. The electron emission device according to claim 10, wherein the at least one band is formed at the first conductive layer, the second conductive layer, or both the first and second conductive layers.

12. The electron emission device according to claim 11, wherein the at least one band is formed at the first conductive layer, and the first conductive layer includes a material having a lower melting point than that of the second conductive layer.

13. The electron emission device according to claim 12, wherein the first conductive layer includes a material selected from Ag, Al, Zn, Mg, Sr, or any suitable alloy thereof, and the second conductive layer includes a material selected from Au, Cu, Fe, Th, Cr, Mo, Ni, Ta, W, Zr, Pt, or any suitable alloy thereof.

14. The electron emission device according to claim 10, wherein the predetermined width of the at least one band is less than a width of the second driving electrode.

15. An electron emission display comprising:

a first plate and a second plate disposed to be opposite to each other;

at least one first driving electrode and at least one second driving electrode disposed to be insulated from each other on the first plate;

an electron emission portion connected to the at least one first driving electrode and for emitting electrons in response to a voltage difference between the at least one first driving electrode and the at least one second driving electrode; and an image realizing portion formed on the second plate and for displaying a picture based on the electrons emitted from the electron emission portion, wherein the at least one second driving electrode has at least two separate portions that are coupled to each other by at least one band having a predetermined width adapted to electrically isolate at least one of the at least two separate portions of the at least one second driving electrode from the electron emission portion when an overcurrent is applied between the at least one second driving electrode and the electron emission portion.

16. The electron emission display according to claim 15, wherein the at least one first driving electrode and the at least one second driving electrode cross each other and define a pixel, and the pixel is provided with at least two electron emission portions.

17. The electron emission display according to claim 15, wherein the at least one band and the at least one second driving electrode are made of a same or different materials.

18. The electron emission display according to claim 17, wherein the at least one band and the at least one second driving electrode are made of different materials, and the at least one band is made of a material having a lower melting point than that of the at least one second driving electrode.

19. The electron emission display according to claim 15, further comprising an insulating layer formed on the at least one first driving electrode and through which at least a portion of the electron emission portion is exposed.

20. The electron emission display according to claim 15, wherein the at least one first driving electrode and the at least one second driving electrode are spatially insulated from each other.

* * * * *